US006050621A

United States Patent [19]

Martinez, Jr. et al.

[11] Patent Number: 6,050,621

[45] Date of Patent: Apr. 18, 2000

[54] TRUCK SLIDING WINDOW LOCKING SYSTEM

[76] Inventors: Gerardo L. Martinez, Jr.; Denise Lozano-Martinez, both of 603 Kirk Pl., San Antonio, Tex. 78225

[21] Appl. No.: 09/226,259

[22] Filed: Jan. 7, 1999

[51] Int. Cl.[7] ..... E05C 19/18

[52] U.S. Cl. ..... 292/289; 292/288; 292/259 R

[58] Field of Search ..... 292/289, 259 R, 292/288

[56] References Cited

U.S. PATENT DOCUMENTS

| | | | |
|---|---|---|---|
| 3,656,788 | 4/1972 | Emery | 292/259 R |
| 3,993,336 | 11/1976 | Frost | 292/288 X |
| 4,073,522 | 2/1978 | Tierney | 292/288 |
| 4,105,233 | 8/1978 | Levey | 292/288 |
| 4,330,147 | 5/1982 | Nolen | 292/259 R |
| 4,548,436 | 10/1985 | Cole, Jr. | 292/259 R |
| 4,838,243 | 6/1989 | Kuber | 292/259 R |
| 4,846,513 | 7/1989 | Mathis, II | 292/288 |
| 4,993,761 | 2/1991 | Paskert | 292/288 |
| 5,102,001 | 4/1992 | Teague et al. | 292/289 |
| 5,232,254 | 8/1993 | Teaff | 292/259 R |
| 5,364,140 | 11/1994 | Rice | 292/288 |
| 5,431,461 | 7/1995 | Anderson, III et al. | 292/288 |
| 5,447,346 | 9/1995 | Virzi | 292/289 |
| 5,462,323 | 10/1995 | Benninger | 292/288 |
| 5,474,343 | 12/1995 | Ledbetter | 292/259 R |

FOREIGN PATENT DOCUMENTS

| | | | |
|---|---|---|---|
| 2554495 | 5/1985 | France | 292/259 R |

*Primary Examiner*—Teri Pham

[57] ABSTRACT

A sliding window locking device is provided including a strip having a planar rectangular configuration. The strip is defined by a first side face, a second side face, and a periphery formed therebetween. Such periphery is formed of an elongated linear top edge, an elongated linear bottom edge, and a pair of short linear end edges. A handle portion is integrally formed on the top edge of the strip and extends upwardly therefrom for being gripped by a user. The strip is adapted to be positioned within a groove of a lower portion of a frame of a vehicular window assembly for maintaining a sliding window pane in a closed orientation.

10 Claims, 1 Drawing Sheet

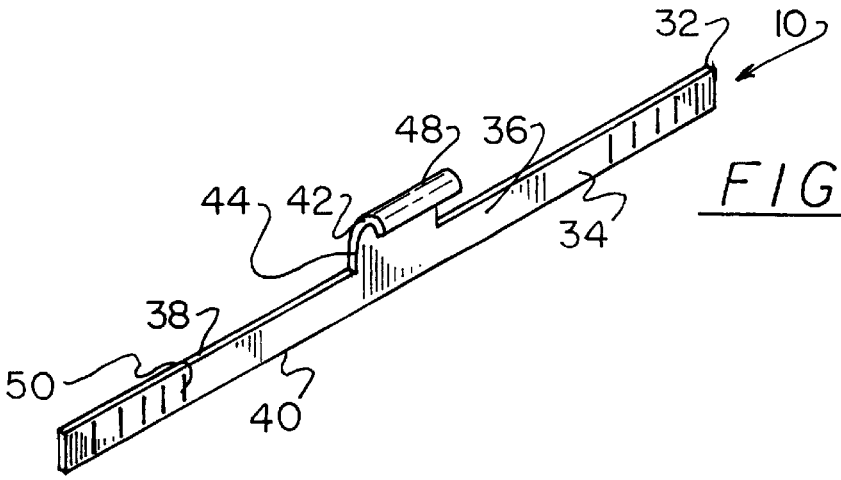
FIG. 1
FIG. 2
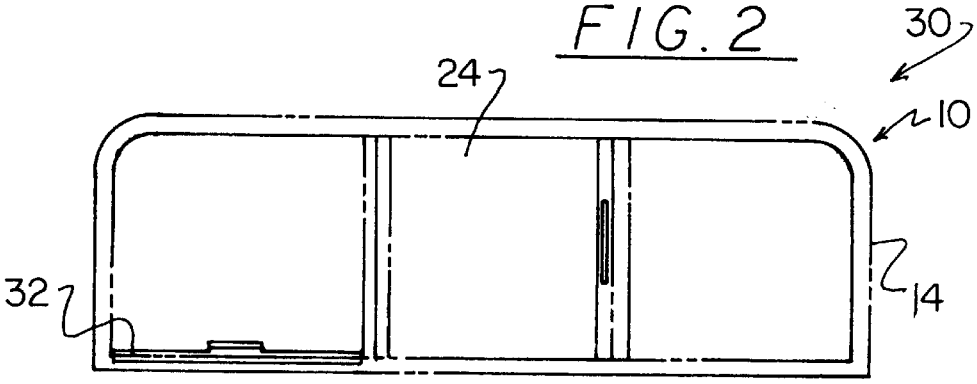
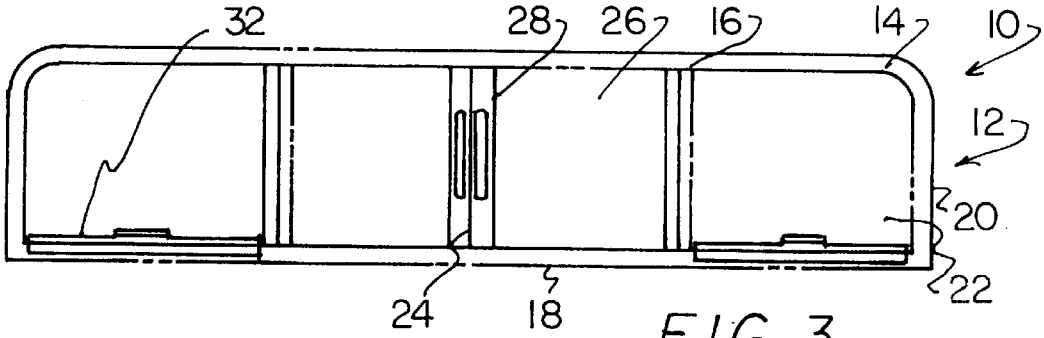
FIG. 3
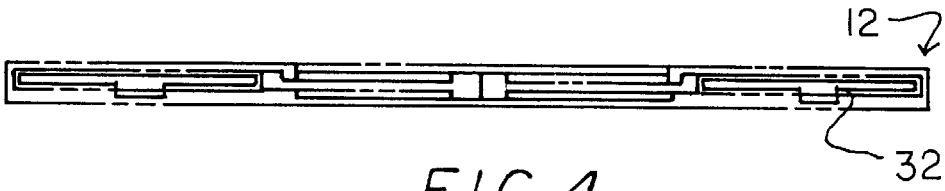
FIG. 4

TRUCK SLIDING WINDOW LOCKING SYSTEM

BACKGROUND OF THE INVENTION

1. Field of the Invention

The present invention relates to window bar locks and more particularly pertains to a new truck sliding window locking system for preventing unauthorized opening of a vehicular sliding window.

2. Description of the Prior Art

The use of window bar locks is known in the prior art. More specifically, window bar locks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,447,346; U.S. Pat. No. 4,846,513; U.S. Pat. No. Des. 349,638; U.S. Pat. No. 5,431,461; U.S. Pat. No. 4,105,233; and U.S. Pat. No. 2,775,001.

In these respects, the truck sliding window locking system according to the present invention substantially departs from the conventional concepts and designs of the prior art, and in so doing provides an apparatus primarily developed for the purpose of preventing unauthorized opening of a vehicular sliding window.

SUMMARY OF THE INVENTION

In view of the foregoing disadvantages inherent in the known types of window bar locks now present in the prior art, the present invention provides a new truck sliding window locking system construction wherein the same can be utilized for preventing unauthorized opening of a vehicular sliding window.

The general purpose of the present invention, which will be described subsequently in greater detail, is to provide a new truck sliding window locking system apparatus and method which has many of the advantages of the window bar locks mentioned heretofore and many novel features that result in a new truck sliding window locking system which is not anticipated, rendered obvious, suggested, or even implied by any of the prior art window bar locks, either alone or in any combination thereof.

To attain this, the present invention is adapted for use with a vehicular window assembly having a frame with a rectangular configuration. The frame is defined by an elongated top portion, an elongated bottom portion, and a pair of short side portions formed therebetween. The window assembly further includes stationary glass panes mounted between side extents of the top portion and the bottom portion of the frame. As such, a central opening is defined. The window assembly further has a pair of sliding glass panes each slidably mounted within grooves formed in the top portion and the bottom portion of the frame. The sliding glass panes are adapted for being slid between a first orientation in front of one of the stationary glass panes and a second orientation covering the central opening. The sliding glass panes each have an inboard edge with a handle strip mounted along a length thereof. The present invention includes a window stopper having a strip with a planar rectangular configuration defined by a first side face and a second side face both of which are smooth and planar along their entire extent. A periphery of the strip is defined by an elongated linear top edge, an elongated linear bottom edge, and a pair of short linear end edges. It should be noted that a thickness of the strip is equal to that of the groove of the window assembly. The window stopper also includes a handle portion having a lower extent with a planar rectangular configuration defined by a first face, a second face and a periphery. The periphery of the handle is formed of an elongated linear top edge, an elongated linear bottom edge, and a pair of short linear end edges. The bottom edge of the lower extent of the handle portion is integrally formed on the top edge of the strip. As such, the first face of the lower extent of the handle portion is in coplanar relationship with that of the strip. Further, the second face of the lower extent of the handle portion is in coplanar relationship with that of the strip. A height of the lower extent of the handle portion is preferably equal to that of the strip. Further, a length of the lower extent of the handle portion is about ⅛ that of the handle. As shown in FIG. 1, the handle portion further includes an upper extent with a semicylindrical configuration defined by a pair of semicircular end edges and a pair of linear side edges. One of the side edges is integrally formed along the top edge of the lower extent of the handle portion. As such, the side edges of the upper extent of the handle portion reside in a plane perpendicular with respect to that of the strip. The upper extent of the handle portion has an inverted U-shaped cross-section along an entire length thereof. Further, the upper extent of the handle is equipped with a diameter equal to the height of the lower extent of the handle portion. Finally, a plurality of equally spaced vertical lines are positioned on one of the faces of the strip between the top edge and the bottom edge thereof. The vertical lines allow a length of the strip to be reduced to an amount sufficient to allow the strip to be positioned within the groove of the lower portion of the frame of the window assembly and between one of the side portions of the frame of the window assembly and one of the sliding glass panes thereof. In such position, the strip of the window stopper is adapted for maintaining the sliding glass panes in the second orientation, thereby preventing unauthorized entry into the vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new truck sliding window locking system apparatus and method which has many of the advantages of the window bar locks mentioned heretofore and many novel features that result in a new truck sliding window locking system which is not anticipated, rendered obvious, suggested, or even implied by any of the prior art window bar locks, either alone or in any combination thereof.

It is another object of the present invention to provide a new truck sliding window locking system which may be easily and efficiently manufactured and marketed.

It is a further object of the present invention to provide a new truck sliding window locking system which is of a durable and reliable construction.

An even further object of the present invention is to provide a new truck sliding window locking system which is susceptible of a low cost of manufacture with regard to both materials and labor, and which accordingly is then susceptible of low prices of sale to the consuming public, thereby making such truck sliding window locking system economically available to the buying public.

Still yet another object of the present invention is to provide a new truck sliding window locking system which provides in the apparatuses and methods of the prior art some of the advantages thereof, while simultaneously overcoming some of the disadvantages normally associated therewith.

Still another object of the present invention is to provide a new truck sliding window locking system for preventing unauthorized opening of a vehicular sliding window.

Even still another object of the present invention is to provide a new truck sliding window locking system that includes a strip having a planar rectangular configuration. The strip is defined by a first side face, a second side face, and a periphery formed therebetween. Such periphery is formed of an elongated linear top edge, an elongated linear bottom edge, and a pair of short linear end edges. A handle portion is integrally formed on the top edge of the strip and extends upwardly therefrom for being gripped by a user. The strip is adapted to be positioned within a groove of a lower portion of a frame of a vehicular window assembly for maintaining a sliding window pane in a closed orientation.

These together with other objects of the invention, along with the various features of novelty which characterize the invention, are pointed out with particularity in the claims annexed to and forming a part of this disclosure. For a better understanding of the invention, its operating advantages and the :specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new truck sliding window locking system according to the present invention.

FIG. 2 is a front view of the present invention during use with a window assembly having a single sliding glass pane.

FIG. 3 is a front view of the present invention during use with a window assembly having a pair of sliding glass panes.

FIG. 4 is a top cross-sectional view of the present invention.

DESCRIPTION OF THE PREFERRED EMBODIMENT

With reference now to the drawings, and in particular to FIGS. 1 through 4 thereof, a new truck sliding window locking system embodying the principles and concepts of the present invention and generally designated by the reference numeral 10 will be described.

The present invention, designated as numeral 10, is adapted for use with a vehicular window assembly 12 having a frame 14 with a rectangular configuration. The frame is defined by an elongated top portion 16, an elongated bottom portion 18, and a pair of short side portions 20 formed therebetween. The window assembly further includes stationary glass panes 22 mounted between side extents of the top portion and the bottom portion of the frame. As such, a central opening 24 is defined.

As shown in FIGS. 3 & 4, the window assembly further has a pair of sliding glass panes 26 each slidably mounted within grooves formed in the top portion and the bottom portion of the frame. The sliding glass panes are adapted for being slid between a first orientation in front of one of the stationary glass panes and a second orientation covering the central opening. The sliding glass panes each have an inboard edge with a handle strip 28 mounted along a length thereof. In an alternate embodiment 30, the window assembly may be equipped with a single glass pane.

The present invention includes a window stopper 32 constructed completely from a transparent rigid plastic material. It should be noted that various other colors may be employed when designing the present invention. The window stopper is shown in FIG. 1 to have a strip 34 with a planar rectangular configuration defined by a first side face 36 and a second side face 38 both of which arc smooth and planar along their entire extent. A periphery 40 of the strip is defined by an elongated linear top edge, an elongated linear bottom edge, and a pair of short linear end edges. It should be noted that a thickness of the strip is equal to that of the groove of the window assembly. Ideally, the strip has a thickness of ¼ of an inch, a height of ½ of an inch, and a length of 22 and ½ inches. As such, the thickness of the strip is preferably about ½ that of the height, thereby augmenting the rigidity of the strip and making it ideally dimensioned for its intended environment.

The window stopper also includes a handle portion 42 having a lower extent 44 with a planar rectangular configuration defined by a first face, a second face and a periphery. The periphery of the lower extent of the handle is formed of an elongated linear top edge, an elongated linear bottom edge, and a pair of short linear end edges. The bottom edge of the lower extent of the handle portion is integrally formed on the top edge of the strip. As such, the first face of the lower extent of the handle portion is in coplanar relationship with that of the strip. Further, the second face of the lower extent of the handle portion is in coplanar relationship with that of the strip. A height of the lower extent of the handle portion is preferably equal to that of the strip. Further, a length of the lower extent of the handle portion is about ⅛ that of the handle.

As shown in FIG. 1, the handle portion further includes an upper extent 48 with a semicylindrical configuration defined by a pair of semicircular end edges and a pair of linear side edges. One of the side edges is integrally formed along the top edge of the lower extent of the handle portion. As such, the side edges of the upper extent of the handle portion reside in a plane perpendicular with respect to that of the strip. The upper extent of the handle portion has an inverted U-shaped cross-section along an entire length thereof. Further, the upper extent of the handle is equipped with a diameter equal to the height of the lower extent of the handle portion.

Finally, a plurality of equally spaced vertical lines 50 are positioned on at least one of the faces of the strip between the top edge and the bottom edge thereof. The vertical lines allow a length of the strip to be reduced with a hack saw or sharp edge. The length of the strip is preferably reduced to an amount sufficient to allow the strip to be positioned within the groove of the lower portion of the frame of the window assembly and between one of the side portions of the frame of the window assembly and one of the sliding glass panes thereof. In such position, the strip of the window stopper is adapted for maintaining the sliding glass panes in the second orientation, thereby preventing unauthorized entry into the vehicle. In order to ensure that the present invention may be sized to fit a vast amount of vehicles, the vertical lines preferably are positioned to allow the strip to be reduced to lengths of 19¼ inches, 8 inches, 13½ inches, 12⅜ inches, 10½ inches, 15¹⁄₁₆ inches, and 13¾ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sliding window system comprising, in combination:

a vehicular window assembly including a frame with a rectangular configuration defined by an elongated top portion, an elongated bottom portion, and a pair of short side portions formed therebetween, the window assembly further including stationary glass panes mounted between side extents of the top portion and the bottom portion of the frame for defining a central opening, the window assembly further having a pair of sliding glass panes each slidably mounted within grooves formed in the top portion and the bottom portion of the frame for being slid between a first orientation in front of one of the stationary glass panes and a second orientation covering the central opening, the groove in the bottom portion having upstanding spaced side walls and a bottom wall extending therebetween, wherein the sliding glass panes each have an inboard edge with a handle strip mounted along a length thereof;

a strip having a planar rectangular configuration defined by a first side face which is smooth and planar along its entire extent, a second side face which is smooth and planar along its entire extent, and a periphery formed therebetween defined by an elongated linear top edge, an elongated linear bottom edge, and a pair of short linear end edges, wherein a thickness of the strip is equal to that of the groove of the window assembly, the strip being removably insertable into the groove to restrict sliding of the glass panes within the grooves such that the side and bottom walls of the groove support the strip in position until removal of the strip;

a handle portion including a lower extent having a planar rectangular configuration defined by a first face, a second face and a periphery defined by an elongated linear top edge, an elongated linear bottom edge, and a pair of short linear end edges, wherein the bottom edge of the lower extent of the handle portion is integrally formed on the top edge of the strip such that the first face of the lower extent of the handle portion is in coplanar relationship with that of the strip and the second face of the lower extent of the handle portion is in coplanar relationship with that of the strip, wherein a height of the lower extent of the handle portion is equal to that of the strip and a length of the lower extent of the handle portion is about ⅛ that of the handle, the handle portion further including an upper extent with a semicylindrical configuration defined by a pair of semicircular end edges and a pair of linear side edges one of which is integrally formed along the top edge of the lower extent of the handle portion such that the side edges of the upper extent of the handle portion reside in a plane perpendicular with respect to that of the strip, wherein the upper extent of the handle portion has an inverted U-shaped cross-section along an entire length thereof and has a diameter equal to the height of the lower extent of the handle portion; and a plurality of spaced lines positioned on one of the faces of the strip and extending between the top edge and the bottom edge thereof, the spaced lines defining a variety of predetermined strip length dimensions therebetween such that cutting of the strip at a pair of lines spaced at selected distances allows a length of the strip to be reduced to an amount sufficient to allow the strip to be positioned within the groove of the lower portion of the frame of the window assembly and between one of the side portions of the frame of the window assembly and one of the sliding glass panes of the window assembly for blocking sliding movement of the glass pane out of the second orientation.

2. A sliding window locking [device] system comprising:

a strip having a planar rectangular configuration defined by a first side face, a second side face, and a periphery formed therebetween defined by an elongated linear top edge, an elongated linear bottom edge, and a pair of short linear end edges;

a handle portion integrally formed on the top edge of the strip and extending upwardly therefrom for being gripped by a user;

a plurality of spaced lines positioned on one of the faces of the strip and extending between the top edge and the bottom edge thereof, the spaced lines defining a variety of predetermined strip length dimensions therebetween such that cutting of the strip at a pair of lines spaced at selected distances allows a length of the strip to be reduced;

a vehicular window assembly having a sliding window pane and a groove in a lower portion of a frame of the window assembly; and wherein the strip is positionable in the groove of the lower portion of the frame of the vehicular window assembly for restricting sliding movement of the sliding window pane from a closed orientation when the strip is positioned in the groove.

3. A sliding window locking system as set forth in claim 2 wherein the first side face is smooth and planar along its entire extent and the second side face is smooth and planar along its entire extent.

4. A sliding window locking system as set forth in claim 2 wherein the handle includes an upper extent that is arcuate.

5. A sliding window locking system as set forth in claim 4 wherein the upper extent has a semicylindrical configuration.

6. A sliding window locking system as set forth in claim 2 wherein the plurality of lines are equally spaced apart between adjacent pairs of the lines.

7. A sliding window locking system comprising:

a strip having a planar rectangular configuration defined by a first side face, a second side face, and a periphery formed therebetween defined by an elongated linear top edge, an elongated linear bottom edge, and a pair of short linear end edges;

a handle portion integrally formed on the top edge of the strip and extending upwardly therefrom for being gripped by a user;

a vehicular window assembly having a sliding window pane and a groove in a lower portion of a frame of the window assembly;

wherein the strip is positionable in the groove of the lower portion of the frame of the vehicular window assembly for maintaining the sliding window pane in a closed orientation when the strip is positioned in the groove; and a plurality of equally spaced lines positioned on at least one of the faces of the strip and extending between the top edge and the bottom edge thereof.

8. A sliding window locking system as set forth in claim 7 wherein the first side face is smooth and planar along its entire extent and the second side face is smooth and planar along its entire extent.

9. A sliding window locking system as set forth in claim 8 wherein the upper extent has a semicylindrical configuration.

10. A sliding window locking system as set forth in claim 7 wherein the handle includes an upper extent that is arcuate.

* * * * *